United States Patent [19]

Duwe et al.

[11] 4,132,046

[45] Jan. 2, 1979

[54] METHOD OF MAKING MODULAR CRYPTS

[76] Inventors: Edward C. Duwe, 3840 Highland Shores, Oshkosh, Wis. 54901; William E. Duwe, 1203 Washington Ave., Oshkosh, Wis. 54901

[21] Appl. No.: 780,230

[22] Filed: Mar. 22, 1977

Related U.S. Application Data

[60] Division of Ser. No. 622,060, Oct. 14, 1975, Pat. No. 4,033,545, which is a continuation-in-part of Ser. No. 514,932, Oct. 15, 1974, Pat. No. 3,938,773.

[51] Int. Cl.[2] ..... E04B 1/04; E02D 35/00

[52] U.S. Cl. ..... 52/745; 52/79.1; 52/127; 52/134; 249/156; 264/35; 264/71; 264/334

[58] Field of Search ..... 249/155, 156; 52/79.1, 52/127, 134, 136, 745; 264/35, 71, 334

[56] References Cited

U.S. PATENT DOCUMENTS

| | | | |
|---|---|---|---|
| 799,373 | 9/1905 | Gaebler | 264/275 |
| 2,344,206 | 3/1944 | Forni | 264/336 X |
| 2,708,780 | 5/1955 | Burkhalter | 249/156 X |
| 3,635,354 | 1/1972 | Martin | 52/79.2 X |
| 3,643,814 | 2/1972 | Martin | 52/236.3 X |

*Primary Examiner*—Thomas P. Pavelko
*Attorney, Agent, or Firm*—Wigman & Cohen

[57] ABSTRACT

A method of casting a plurality of differently configured reinforced concrete crypt modules for use in constructing a substantially monolithic mausoleum edifice is disclosed. A single, universal casting form and a plurality of removable inserts, each adapted to be connected to the casting form are provided. Selected predetermined combinations of the removable inserts are secured to the casting form to alter the exterior configurations of the crypt modules cast in the form in such a way that each differently configured crypt module is provided with interlocking surfaces which are adapted to interlock with complementary interlocking surfaces of another such crypt module.

3 Claims, 17 Drawing Figures

FIG. 13
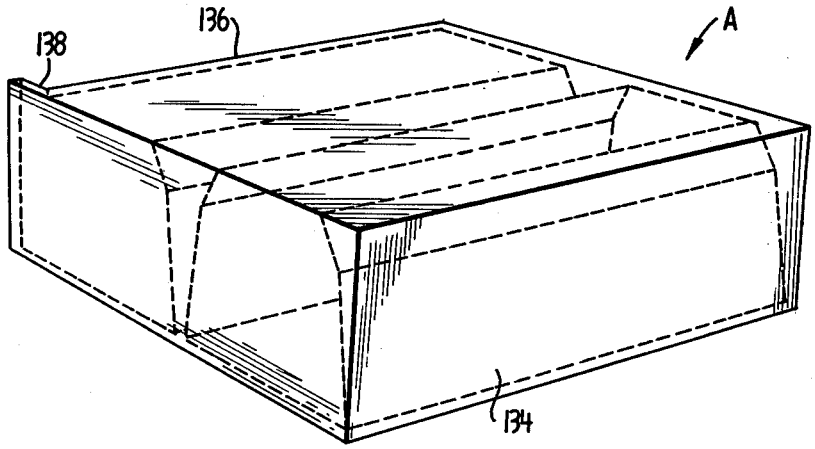
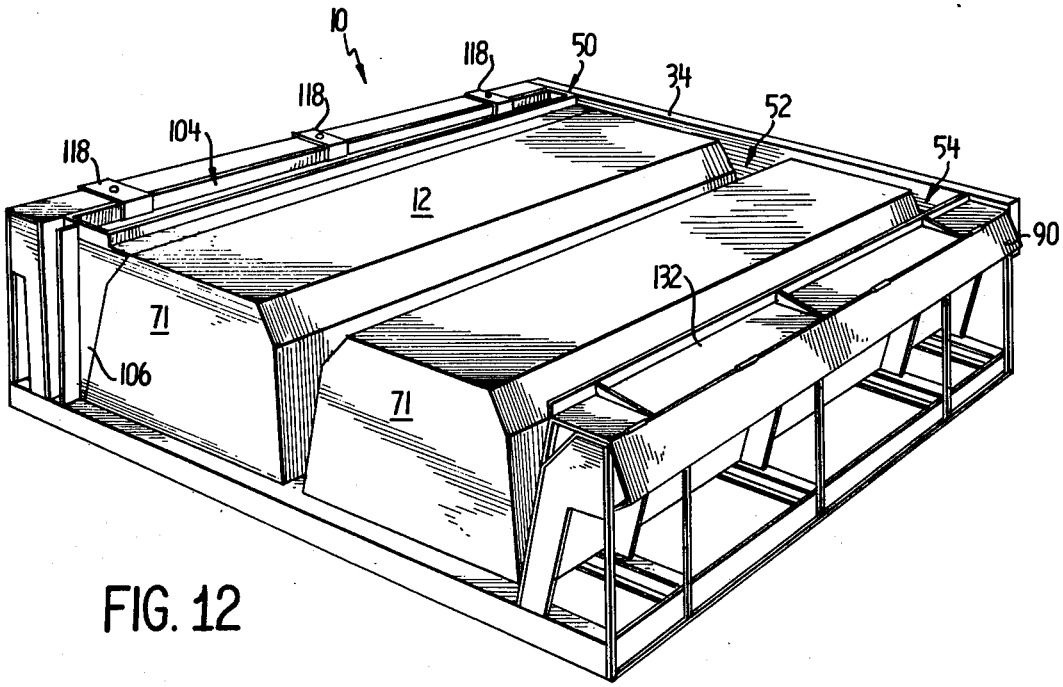
FIG. 12

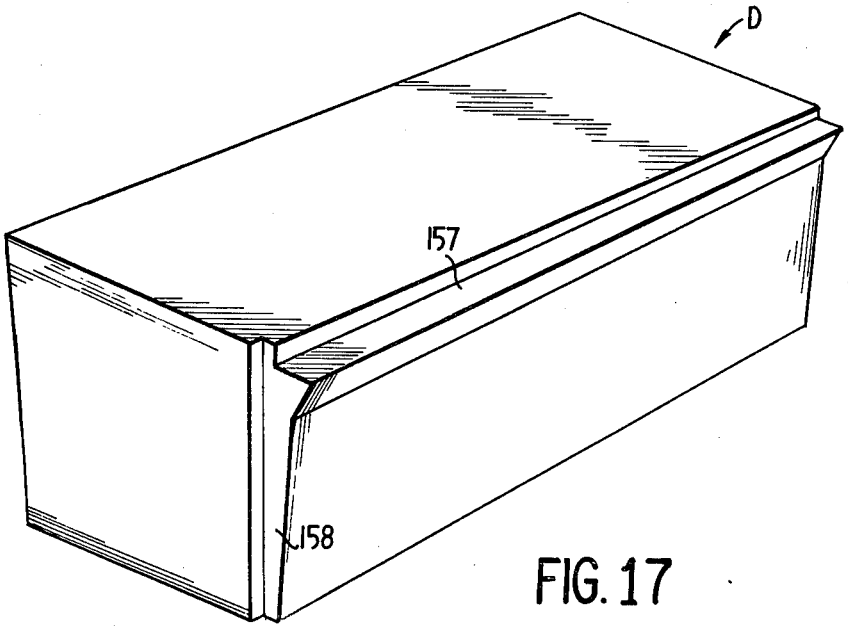
FIG. 17
FIG. 16
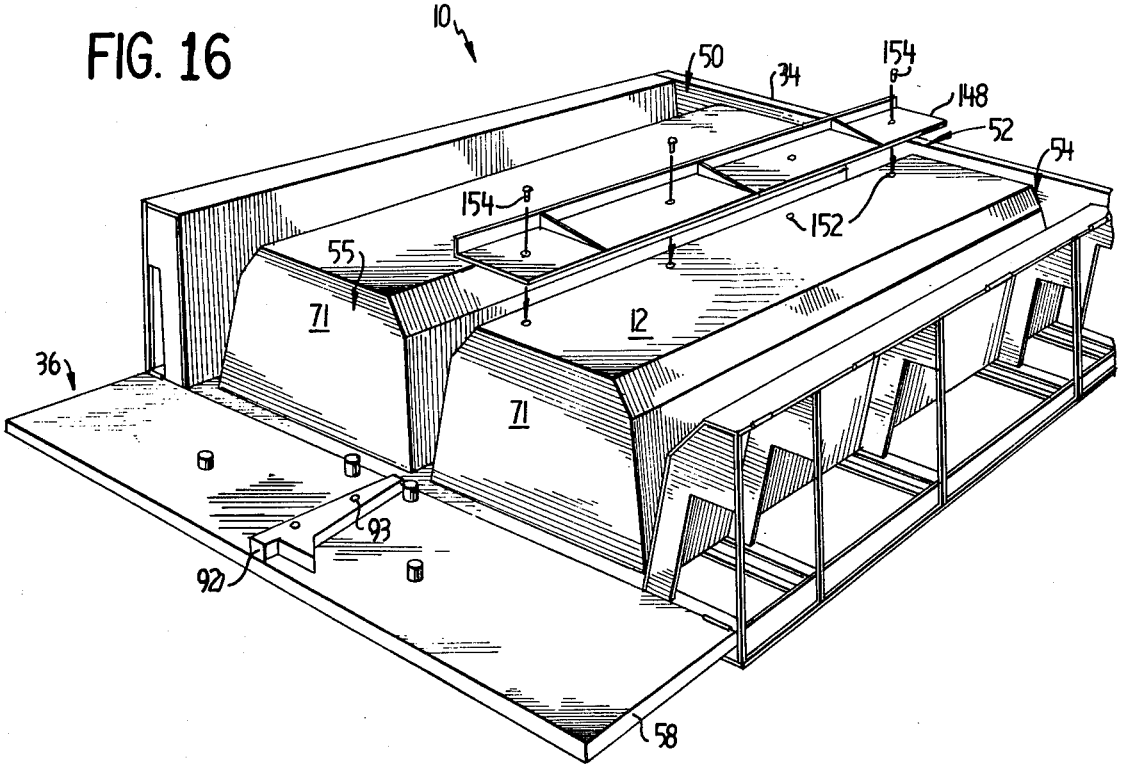

METHOD OF MAKING MODULAR CRYPTS

This application is a division of Ser. No. 622,060, filed Oct. 14, 1975, now U.S. Pat. No. 4,033,545, issued July 5, 1977; which in turn was a continuation-in-part of Ser. No. 514,932, filed Oct. 15, 1974, now U.S. Pat. No. 3,938,773, issued Feb. 17, 1976.

BACKGROUND OF THE INVENTION

1. Field of the Invention

This invention relates to a method of casting concrete structural elements. More particularly, the invention relates to an improved casting method for economically casting differing complex-shaped concrete crypt modules for mausoleum structures of the type disclosed in our U.S. Pat. No. 3,878,656, entitled "Modular Mausoleum Crypt System."

2. Description of the Prior Art

In recent years there has been increasing emphasis placed on the efficient utilization of land, especially for burial purposes in areas where the population growth has been significant. One particular pressing problem which has received attention for at least the past two decades is the use of above-ground mausoleums, similar in concept to highrise apartments. The advantages of the above-ground, multi-level mausoleums are readily seen since this concept permits a more efficient utilization of land and has the added advantage of permitting visitors to be indoors while paying respects to the deceased.

Heretofore, a variety of construction techniques have been employed to construct multi-level, above-ground mausoleums. One such technique utilizes a "poured-in-place" method used in apartment construction. Thus, concrete is poured in forms on the construction site, level by level, until the entire structure is completed. In this manner, a multi-story mausoleum can be fabricated according to a predetermined design. This approach yields a highly satisfactory product but is economically undesirable by virtue of the slow and relatively expensive construction technique employed.

A variety of techniques for casting concrete structural elements in a shaped form are known. One technique for casting relatively large reinforced concrete components is to initially fabricate a wooden form and cast therein a concrete pattern of the shape of the ultimately desired component. A final concrete form is then fabricated by pouring concrete within a wall constructed around the concrete pattern which is removed when the concrete sets. A significant disadvantage of this technique is that the concrete form is entirely inflexible. Unless very accurately controlled drafts of substantial magnitudes are used, removal of the cast component from such an inflexible concrete form results in damage to the form or the cast component, or both.

Others have utilized forms fabricated from metal plate for casting concrete structural elements. However, this approach utilized rigid, heavy metal plates to prevent deformation of the form and consequent difficulty in releasing the element as well as undesirable dimensional distortion thereof. Even though a degree of form flexibility is achieved with a metal plate form, release and removal of the element is still time-consuming and is not satisfactory in all cases involving complex shapes.

To overcome some of the foregoing difficulties encountered when removing a cast concrete element from a form, others have suggested the use of a plurality of separate and detachable sections which, when assembled, receive the poured concrete. To extract the finished element from the form, the form is broken down. Utilization of such forms is obviously time-consuming and unless the mating sections of the form are well fitted and reasonably rigid, the fluent casting material will leak out from the form at the adjoining surfaces of the sections. This disadvantageously results in rapid accumulation of concrete flash and debris on the assembly or production line.

A further significant disadvantage of all the above prior art techniques is the lack of flexibility in providing forms for casting differently configured components. Using the aforementioned prior art techniques of a concrete pattern cast in a wooden form or metal plate forms, a plurality of separate forms is required for components having the same basic structure but having slightly different configurations, such as, for example, the interlocking members of the crypt modules illustrated and described in our aforementioned U.S. Pat. No. 3,878,656. Somewhat more flexibility may be possible with forms fabricated with detachable, variously-configured sections, however, the efficient utilization of such detachable sections is still severely limited by the need to build up the form for casting and subsequently to break down the form to extract the completed component.

OBJECTS AND SUMMARY OF THE INVENTION

In view of the foregoing, it should be apparent that a need still exists in the art for an improved method of making variously configured reinforced concrete structural elements. The present method includes the provision of a casting apparatus that is "universal" in the sense it is capable of making all of the varying complex elements needed to produce the mausoleum structure of our U.S. Pat. No. 3,878,656. The apparatus includes a form which is characterized by sufficient rigidity to prevent distortion of the form surface during pouring, yet sufficiently flexible to permit rapid extraction of the cured element from the form without damage to either the form or element.

A primary object of the present invention is to provide an improved method for economically and readily forming a plurality of differently configured crypt modules having interlocking features for enhancing the structural integrity of a substantially monolithic structure constructed with such elements.

Another object of the invention is to provide a method of casting a plurality of differently configured interlocking crypt modules in a single, "universal" casting form.

Briefly described, these and other objects of the invention are accomplished according to the present method by providing a casting apparatus comprising a sturdy, generally rectangular frame or base for supporting a plurality of generally U-shaped upright brackets arranged in parallel relation in one or more rows beneath a lightweight sheet metal form of predetermined configuration conforming to the shape of the modular crypt being cast. A plurality of longitudinal stiffening members disposed perpendicularly of the brackets and located in cutouts provided on the bracket edges confronting the sheet metal form are affixed to the underside surfaces of the form. A pair of end doors, at least one and preferably both of which are hingedly mounted at its lower portion to the frame, are arranged oppositely of each other to close off the form cavity at the respective end thereof. Each end door is provided with a plurality of slots or openings for engaging respective arm members connected to and extending from locations on the underside of the sheet metal form. Camming means are arranged in at least two vertically-spaced horizontal planes for urging the end doors sealingly against the mating edges of the sheet metal form and the edges of the fixedly mounted oppositely disposed walls of the form, prior to introducing the fluent casting material therein. The engagement of the arm members on the form with the slots or openings on the end doors aids significantly in rigidifying the form prior to the introduction therein of the fluent casting material.

A preferred configuration of the sheet metal casting form of the casting apparatus of the present invention includes three open-ended, longitudinally extending vertical wall cavities having tapered sides for forming a cast module having three spaced side walls. The upper portion of the form terminates below the upper surface of the casting apparatus forming a horizontal cavity which communicates with the vertical cavities. In this way a horizontally disposed top or upper slab of the cast module is formed therein.

A front hinged end door is provided which is sealingly engageable by means of the camming arrangement with the edges of the open ends of the cavities at one end of the casting form. A rear end door, preferably hinged and similarly constructed as the front door, is spaced from the oppositely disposed open ends of the cavities for forming a vertical rear wall slab.

A plurality of detachable inserts are provided for selective connection to the casting apparatus structure in predetermined locations for the purpose of modifying the casting form as desired to form all the various cast modules, e.g., right hand, left hand and intermediate, necessary to construct a substantially monolithic mausoleum structure. Thus, when forming a right hand module, a first removable insert is secured to the hinged rear end door of the casting apparatus for forming a vertically extending notch in the rear wall slab of a cast module which notch is adapted to receive, in interlocking relation, a mating projection of an adjacently situated intermediate or left hand crypt module to be hereinafter described. A second insert is hingedly mounted to one side of the casting apparatus for forming a horizontal ledge at the upper end of an outer side wall of the right hand module to receive a cantilevered portion of the top slab of such adjacent intermediate or left hand crypt module. The horizontal ledge is advantageously non-aligned with the vertical notch so that cracks which may appear along any joint between adjacent modules will be isolated by the discontinuous nature of the joints.

In the arrangement for forming an intermediate crypt module, third and fourth removable inserts are additionally secured to the above arrangement of the apparatus to prevent entry of the fluent casting material into an outer wall cavity in such manner that (1) the horizontal top slab of the intermediate crypt module is supported in cantilevered fashion from the side wall formed by the central cavity of the casting form and is adapted to engage the horizontal ledge in an adjacently situated right hand or another intermediate crypt module and (2) the rear wall projects beyond the cantilevered top slab and is adapted to mate and interlock with the vertical notch in such adjacently situated crypt module. In the arrangement for forming the left hand crypt module, the first and second inserts are removed from the preceding arrangement to eliminate the vertical notch and the horizontal ledge respectively and a fifth insert is removably secured to the casting apparatus for forming a planar outer side wall at the left end of the left hand module. Alternatively, in any of the above-described arrangements, further inserts may be removably secured for the casting form in the rear wall cavity between the edges of the open ends of the wall cavities and the rear hinged end door. These inserts sealingly engage the end door and provide openings in the rear wall similar to those in the other end of the crypt modules.

A significant feature of the present method is, therefore, the provision of a single, universal casting apparatus which may be utilized, to cast, in cooperation with a plurality of removable inserts, at least the three, differently configured, crypt modules designated as modules A (i.e., left hand), B (i.e., intermediate) and C (i.e., right hand) in our aforementioned U.S. Pat. No. 3,878,656. Various combinations of the crypt modules A, B and C formed in the single casting apparatus of the invention can be used to construct a multi-tiered monolithic mausoleum structure having virtually any desired number of individual crypts.

After filling the form cavity with fluent casting material, lifting holes are provided at predetermined spaced locations by inserting a pin into the top surface of the partially set casting material at an angle with respect to the vertical and thereafter removing the pin. Upon setting of the casting material, the end door cams are released, permitting the end doors to be pivoted away from the form, thereby disengaging the arm members from the slots or openings in the doors.

To remove the cast element from the form, Lewis pins, connected by means of four slings to a hoisting device, are inserted in each of the four holes provided in the upper surface of the cast element. With the end doors hinged out of engagement with the arm members of the form, the flexibility thereof is additionally improved over that achieved by the novel arrangement of the U-brackets and angle members alone, so as to permit rapid extraction of the element vertically from the form with no damage to either the form or the cast element.

Another important feature of the apparatus relates to the fabrication of the sheet metal form surface. When possible, of course, is desirable to construct the form surface of a single continuous sheet metal member. If, however, welds are necessary in the form surface, it has been found highly advantageous to locate the welded seam along the bottom of the form surface, i.e., the lowermost portion of the form cavity corresponding to the leg portion of the modular crypt being cast. This construction avoids the possibility, during the extraction of the cast element, of the side walls hanging up on a weld seam.

A further important aspect of the apparatus relates to the combined arrangement of the casting apparatus cavities including a plurality of tapered side wall cavities having an upper widened tapered portion and communicating with a rear wall cavity in a manner to cast integral crypt modules which are in complete structural configuration for ready interconnection together to economically and efficiently construct a substantially monolithic mausoleum structure.

BRIEF DESCRIPTION OF THE DRAWINGS

FIG. 12 is a perspective view of the casting apparatus showing the removable inserts for forming a crypt module A.

FIG. 13 shows a perspective view of the rear of a crypt module A formed in the casting apparatus of FIG. 12.

FIG. 16 is a perspective view of the casting apparatus showing the removable inserts for forming a crypt module D.

FIG. 17 shows a perspective view of the rear of a crypt module D formed in the casting apparatus of FIG. 16.

DETAILED DESCRIPTION OF A PREFERRED EMBODIMENT

Figure 1:
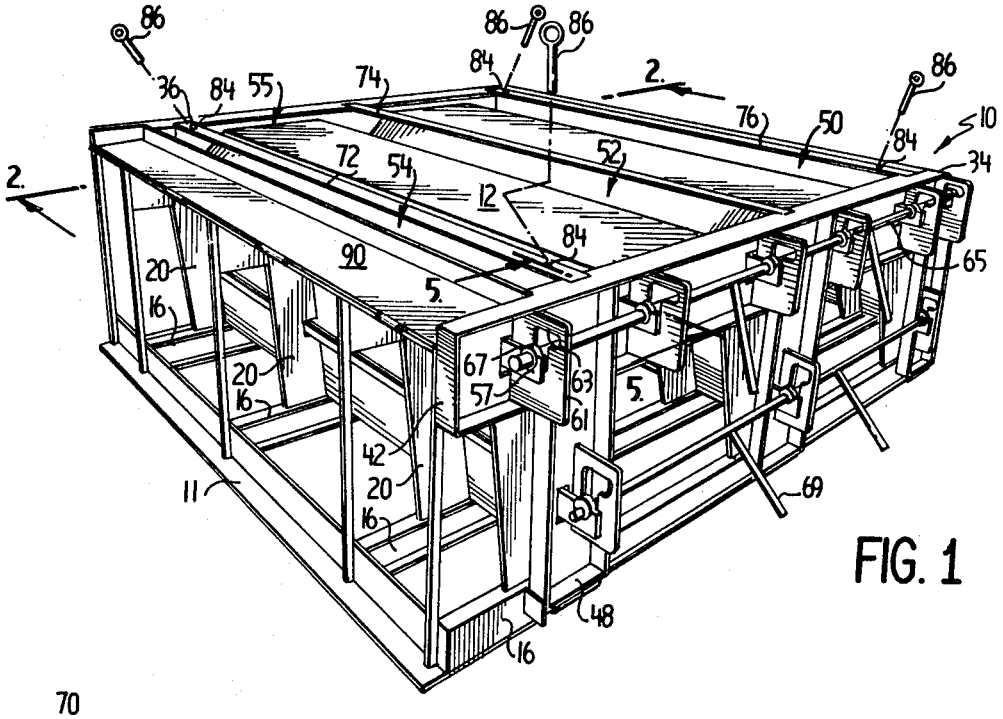
FIG. 1 shows a view in perspective of the casting apparatus of the present invention.
Figure 2:
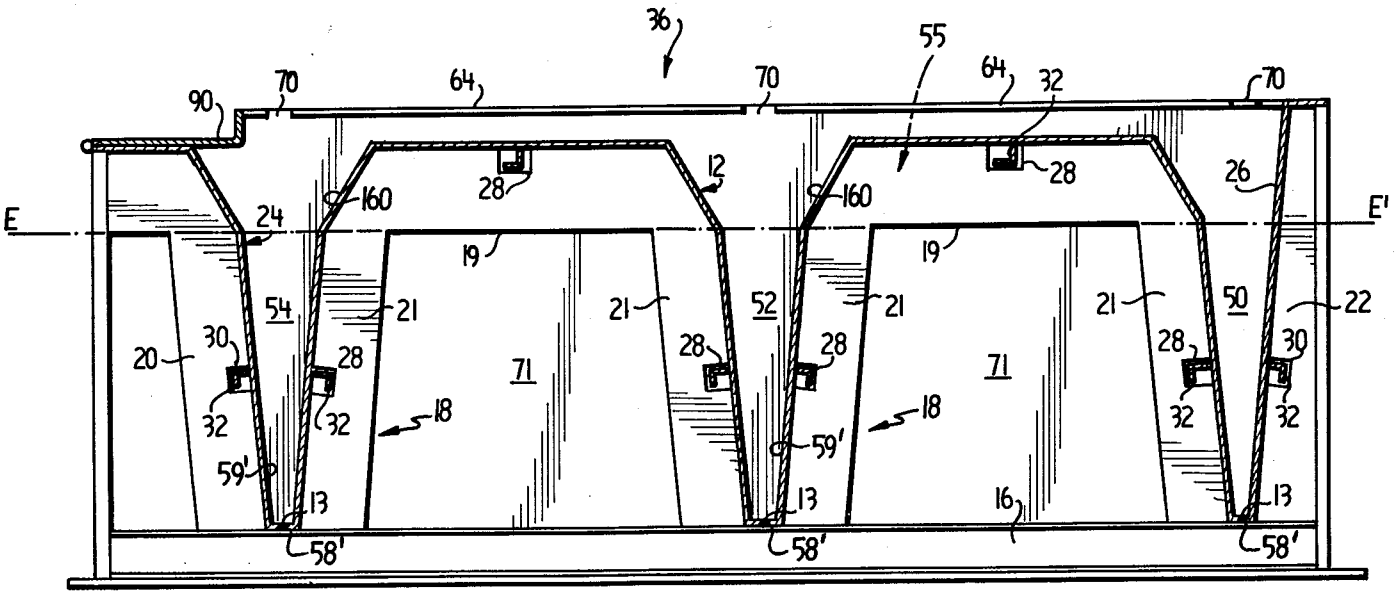
FIG. 2 is a view in cross-section of the casting apparatus taken along section 2—2 of FIG. 1.

Referring now in detail to the drawings, wherein like parts are represented throughout with like reference numerals, FIG. 1 shows a preferred embodiment of the casting apparatus 10 according to the present invention. The casting apparatus 10 includes a rigid rectangular frame or base 11, which may be constructed of rolled-steel channel or other suitable structural members, which in turn supports an internally positioned sheet metal casting form or support 12, with a predetermined cross-section as shown in FIG. 2. Although the form 12 is shown to be configured for casting the crypt module 14 of FIG. 7, it is to be understood that the form 12 may be configured, as hereinafter described, for casting other reinforced concrete elements, as for example, the crypt modules designated A, B, C and D, illustrated in FIG. 3 of our U.S. Pat. No. 3,878,656.

The sheet material of the form 12 of the embodiment described herein is preferably formed of a single sheet of standard 11-gauge stock. If a single sheet is unavailable or cannot be properly shaped with available forming means, the casting form may be provided with welded seams. It is important, however, that the weld be so located to avoid hanging up of the cast element in the form. A preferred weld location is shown in FIG. 2 at the lowermost portions of the form 12 and designated by reference numeral 13.

Figure 4:
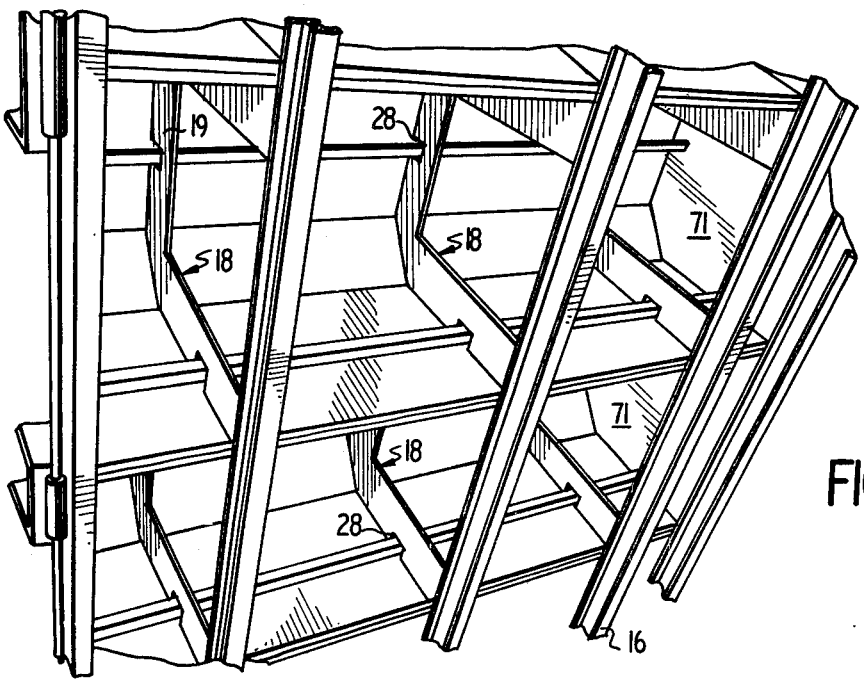
FIG. 4 shows a view in perspective of the exterior side of the casting form as viewed from beneath the casting apparatus of FIG. 1.

Referring now to FIGS. 2 and 4 there is illustrated stiffening means which are positioned interiorly of casting apparatus 10 below the sheet metal form 12 and in substantially adjacent relationship thereto. The base 11 includes a support frame fabricated of attached channel members 16 which support a plurality of spaced, upright, generally U-shaped brackets 18 (FIG. 4) fabricated of sheet metal. Each of the U-shaped brackets 18 includes an upper portion 19 and upright side portions 21, the outer edges of which are in conforming contact with the inner surface of form 12. Also provided are side brackets 20, 22 in spaced relation in planes coincident with the rows of brackets 18. Side brackets 20, 22 are arranged to support the outermost walls 24, 26, respectively, of the form 12. Each bracket 18 has three generally rectangular cutouts or notches 28 in its outwardly disposed edges confronting the exterior of the form 12. One cutout 28 is positioned centrally of the upper portion 19 and the other two notches are located approximately midway along the depending side portions 21. Each side bracket 20, 22 is similarly provided with a cutout 30 positioned approximately midway along its edge confronting the walls 24, 26 of the form 12. Angle brackets 32 are disposed perpendicularly of brackets 18, 20, 22 in the corresponding cutouts of the bracket rows.

Figure 7:
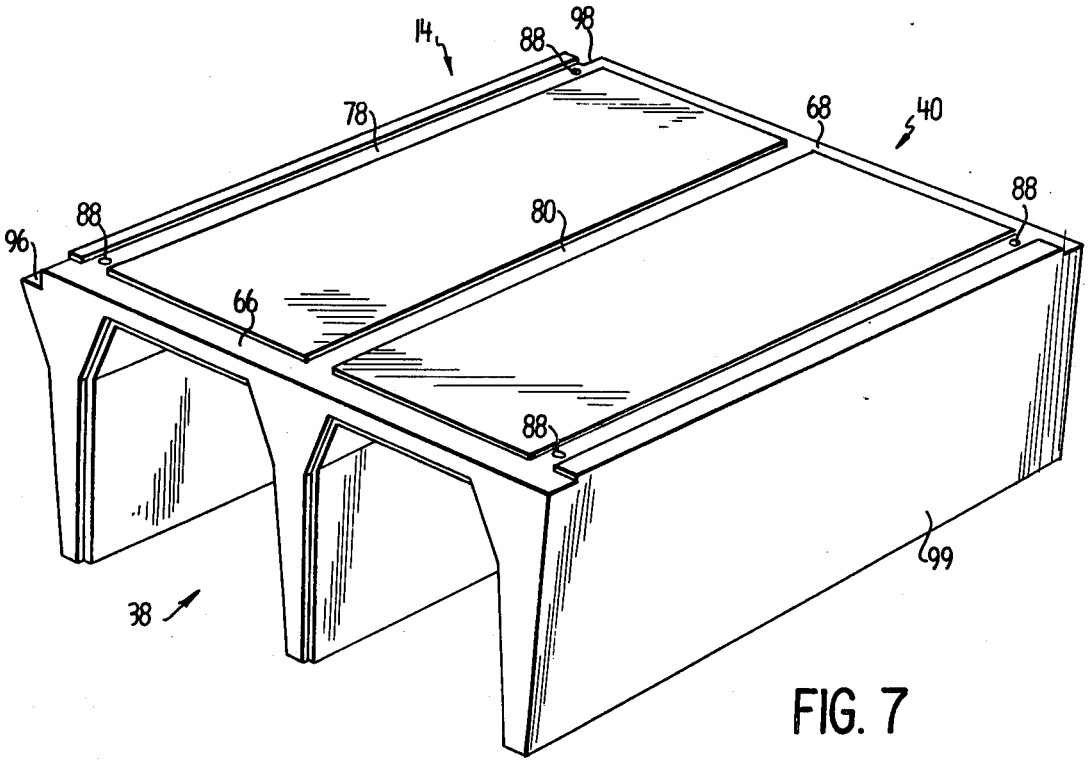
FIG. 7 is a perspective view of a crypt module C cast in the apparatus of FIG. 1 showing the front openings of the crypts.

Referring now to FIGS. 1 and 2, the form 12 is provided with three open-ended longitudinal wall cavities 50, 52, 54 and a rear wall cavity 55 for receiving the casting material. Before the casting material is introduced, the open ends of the casting apparatus are closed by the end doors 34, 36. The end doors 34, 36 are positioned at the ends of the form 12 corresponding to the front 38 and rear 40 respectively, of the crypt module 14 as best seen in FIG. 7.

Figure 3:
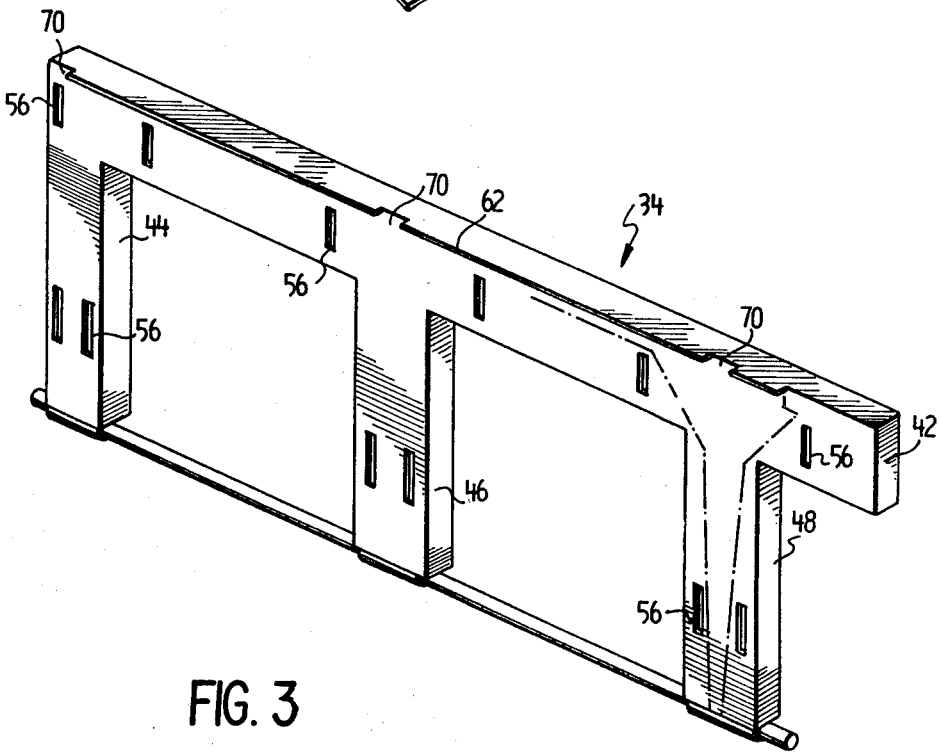
FIG. 3 shows a perspective view of the inwardly facing side of the front hingedly mounted end door.

In FIG. 3, there is shown the front end door 34 which is formed of longitudinal channel member 42, and vertical channel members 44, 46, 48, laterally spaced to confront the open ends of wall cavities 50, 52, 54, respectively, of form 12. Front end door 34 is hingedly mounted to the base 11 via the bottom surfaces of channels 44, 46, 48 to permit it to be pivoted away from the end of form 12 when removing a hardened cast element. A plurality of spaced slots or openings 56 are arranged in two vertically-spaced parallel rows, the first row of slots being disposed in longitudinal channel member 42, the second row in vertical channel members 44, 46, 48.

Figure 5:
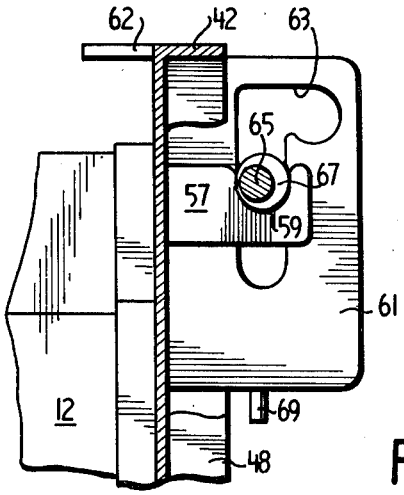
FIG. 5 shows a partially broken side view of the cam means of the invention taken along section 5—5 of FIG. 1.
Figure 6:
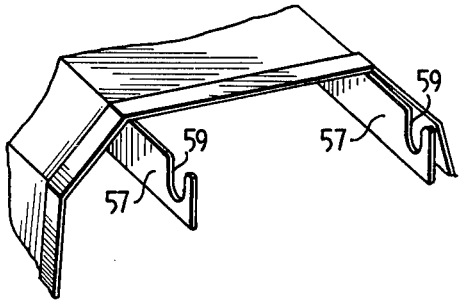
FIG. 6 is a perspective view of a portion of the casting form confronting the front end door of FIG. 3.

The slots 56 are arranged to receive penetrating arm members 57 projecting laterally from opposite ends of the casting form, as best seen in FIGS. 5 and 6. Each arm member 57 is provided with a U-shaped cam slot 59 disposed in the upwardly oriented edge thereof and of a size which conforms with the opening 63 in the adjacent parallely disposed cam plates 61 of channel members 42, 44, 46, 48. Each of cam plates 61 includes an inverted L-shaped opening 63, the long portion of which is arranged generally vertically. The vertical portion of the opening 63 is disposed adjacent the cam slot 59 of the arm member 57 when the end doors 34, 36 are in the upright position. Elongated cam bars 65 are located in the aligned openings 63 of each row of cam plates 61. Axially spaced along the cam bars 65 at the locations of the arm members 57 and slots 56 are eccentric cams 67. With the cams 67 engaged in the cam slots 59 of the arm members 57 and rotated into the position shown in FIG. 5 by cam bar handles 69, the end doors 34, 36 are sealingly urged against the mating surfaces of the casting form 12. End door 36 is provided with a similar arrangement except that cam means and slots are provided only at the outermost sides of the end door.

The engagement of the arm members 57 with the slots 56 is especially advantageous in rigidifying the end of the casting form 12 confronting end door 34. The end of the casting form 12 confronting end door 36 is, of course, made rigid by the end walls 71 thereof. The above described arrangement of stiffening elements, including end walls 71, brackets 18, 20, 22, 32 and arm members 57 engaging slots 56 has been found to provide sufficient rigidity to the sheet metal casting from 12 to prevent distortion thereof when the form is filled with the cementitious casting material, and still exhibit sufficient flexibility to permit rapid extraction of a cast crypt module after the casting material has set or hardened.

Figure 8:
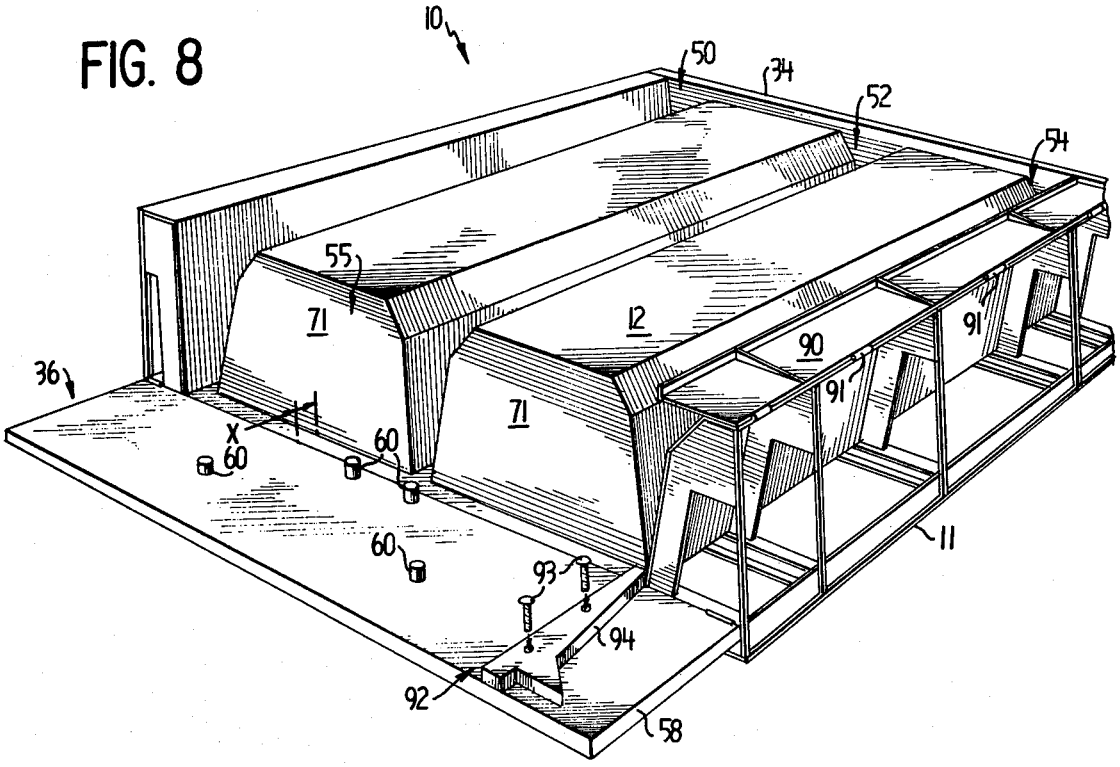
FIG. 8 is a perspective view of the casting apparatus showing the rear hingedly mounted door and the removable insert for forming a crypt module C.

As best seen in FIG. 8, end door 36 is constructed of a flat plate member 58 hingedly mounted at its lower portion to the base 11. In its upright position, end door 36 is spaced from the ends 71 of form 12 to provide a rear wall cavity 55 having a width x for forming a solid wall member at the rearward end of the crypt module. Pins 60 are arranged in predetermined locations to form holes in the solid rear wall of the crypt module in a known manner. Referring again to FIGS. 2 and 3, each end door 34, 36 is provided with overhanging flange members 62, 64 which form the grooves 66, 68 in the front and rear, respectively, of the top surface of crypt module 14. Each flange member 62, 64 is provided with three spaced notches 70 for receiving three longitudinal strips 72, 74, 76 which are inserted in the notches 70, as shown in FIG. 1, subsequently of pouring the fluent casting material into the form 12, and after the material has partially set. The strips 72, 74, 76 are arranged to form the longitudinal grooves 78, 80, 82 in the top surface of crypt module 14. Each end of the strips 72 and 76 is provided with an aperture 84 located so that the diagonals therebetween intersect at a point which is substantially coincident with a vertical line through the center of gravity of a crypt module cast in the form 12.

To prepare the casting apparatus 10 for receiving a fluent casting material, a suitable reinforcing material is inserted in the leg cavities 50, 52, 54. The end doors 34, 36 are pivoted generally upwardly toward the form 12. As the end doors 34, 36 approach the upright position, the arm members 57 penetrate the slots 56 and extend therethrough to the exterior side of the end doors. The cam bars 65 are then positioned in the vertical portion of the opening 63 in plates 61 so that cams 67 engage the cam slots 59 of the arm members 57. The cam bar handles 69 are then rotated downwardly about the cam bar axis so as to urge the end doors 34, 36 sealingly against the mating portions of the casting form 12. The cementitious casting material is introduced by conventional means into the casting apparatus 10 which, if desired, may be agitated by vibration means (not shown) to insure complete filling of the casting form and removal of undesirable air voids which may have been entrapped during pouring. The casting material is poured to a level substantially coincident with the plane of the top surface of the casting apparatus 10. Strips 72, 74, 76 are then located in notches 70 of the flanges 62, 64 of the end doors 34, 36, as hereinbefore described. To accelerate the hardening of the poured-in-place concrete, heating coils or pipes can be placed beneath the frame to convey heat upwardly into the concrete through the form 12. Alternatively, the poured concrete can be air-cured without heat, although a longer time would be required, 3 days as compared to 1 day.

When the concrete has partially set, pins 86 are inserted through respective apertures 84 into the casting material. Preferably, the axis of each pin is disposed in diagonal planes through the holes 84 and forms an angle of approximately 45° with the vertical. Thereafter, the pins 86 are removed, leaving four angularly oriented blind holes 88 in the top surface of a cast crypt module 14.

After the casting material has completely set, the strips 72, 74, 76 are removed and, after releasing the cam means, end doors 34, 36 are pivoted away from the form 12. To remove the cast element from the form, a hoisting apparatus is brought into position over the casting apparatus. A hoisting sling (not shown) made up of four cables or chains of equal length, each attached at one end to a ring and having a Lewis pin secured at the free ends thereof, is attached to the free terminus of the hoisting cable. The Lewis pins are inserted in the angularly disposed holes 88 in the cast element and the hoisting cable is tensed to cause a frictional engagement of the Lewis pins internally of the holes 88. The crypt module may now be extracted from the casting form by raising the hoisting cable vertically. Although it is preferred that the hoisting cable axis coincide with a vertical line through the center of gravity of the cast module, the casting form is sufficiently flexible to permit some variation between the lifting axis and the center of gravity without damage to either the form or the cast module.

Now referring more particularly to FIGS. 8–17 there is illustrated the variously configured crypt modules A (FIG. 13), B (FIG. 11), C (FIG. 9) and D (FIG. 17) and the casting apparatus 10 showing the arrangement of the several removable mold inserts for forming crypt modules, A, B, C and D. For simplicity and clarity, the crypt modules have been illustrated without the front, rear and longitudinal grooves in the top surface of the upper horizontal slab of the modules, it being understood that such grooves are normally cast into each module in the manner hereinbefore described in connection with FIG. 7. Likewise, for clarity, the camming arrangement for the front and rear end doors and other previously described features of the casting apparatus have not been shown in FIGS. 8–17.

Figure 9:
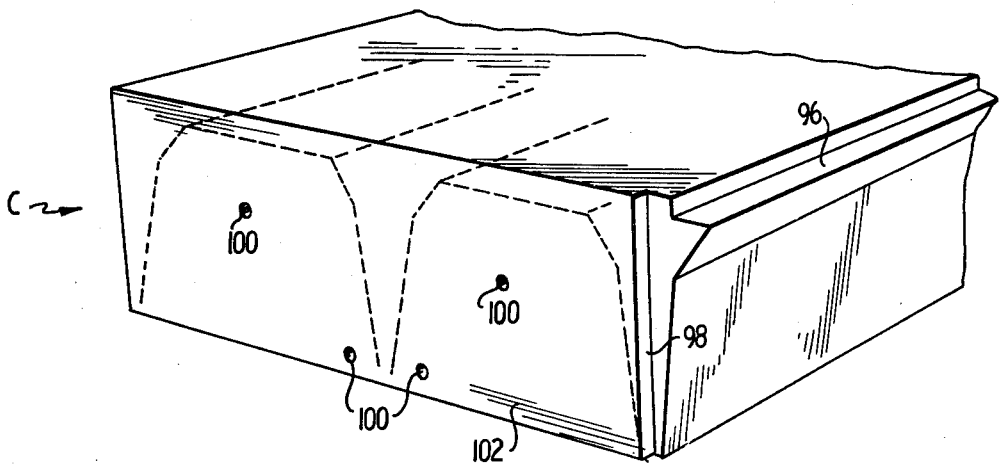
FIG. 9 shows a perspective view of the rear of a crypt module C formed in the casting apparatus of FIG. 8.

FIG. 8 shows the casting apparatus 10 with the rear end door 36 pivoted away from the casting form 12 so as to expose to view the solid end walls 71 and the open-ended wall cavities 50, 52, 54. An insert 90 is pivotally mounted by means of hinges 91 along the side of the casting apparatus adjacent the wall cavity 54 and can be inwardly pivoted into a position overhanging a portion of the wall cavity 54 in the manner shown to partially close off cavity 54. Another insert 92 is detachably secured by means of screws 93 to the inwardly facing surface of the flat plate member 58 of rear end door 36. Insert 92 is provided with a shaped surface 94 on one side thereof which is adapted to sealingly engage complementary surfaces of the casting form 12 and insert 90 when the end door 36 is pivoted to its upright position. Inserts 90 and 92, form the horizontal ledge 96 and vertical notch 98 respectively of a completed right hand module C as shown in FIG. 9. A front view of a module C is depicted by module 14 of FIG. 7 which shows the upper slab grooves and the crypt openings at the front end 38 of the module. Also shown in FIG. 7 is the tapered planar surface 99 of the outer side wall of module 14, which surface is formed by the outermost surface 26 (FIG. 2) of wall cavity 50. Planar surface 99 forms one section of an outer stepped wall of the multi-tiered mausoleum structure as depicted in FIG. 1 of our U.S. Pat. No. 3,878,656. The holes 100 in the rear wall 102 of crypt module C are formed, as previously noted, by the pins 60 in end door 36 and are adapted to be connected in any suitable manner to a plenum chamber of a conventional ventilation system (not shown).

Figure 11:
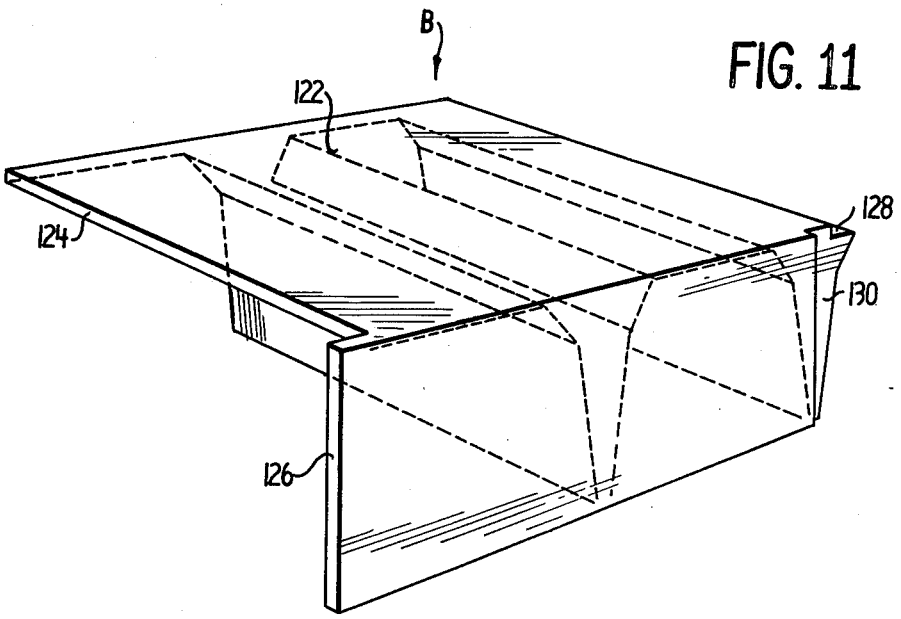
FIG. 11 shows a perspective view of the rear of a crypt module B formed in the casting apparatus of FIG. 10.
Figure 10:
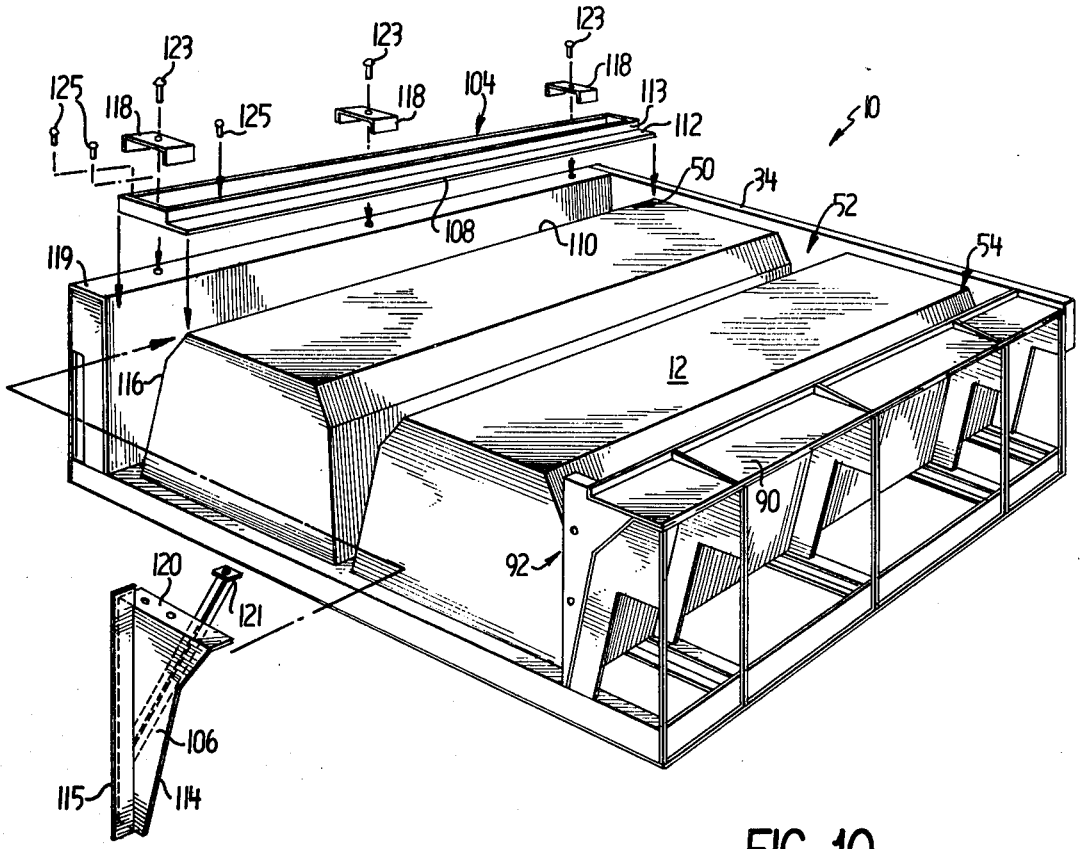
FIG. 10 is a perspective view of the casting apparatus showing the removable inserts for forming a crypt module B.

In FIG. 10 the casting apparatus 10 is shown with the rear end door 36 removed to illustrate the utilization of the removable inserts for casting an intermediate module B (FIG. 11). Inserts 90 and 92 are positioned to provide a horizontal ledge 128 and vertical notch 130 in module B, as more fully described hereinafter. Inserts 104 and 106 are shown as separate members but can be fabricated as a single member. Insert 104 is positioned along the side of the casting apparatus which is opposite insert 90 for closing off the top portion of cavity 50 to the flow of fluent casting material. The edge 108 of insert 104 sealingly contacts the edge 110 of the casting form so that the casting material flows into the recess 112 of insert 104 up to the vertical wall 113 to form a cantilevered upper slab 124 of the cast module B. Insert 106 is positioned to close off the open rear end of wall cavity 50 to prevent entry of casting material therethrough and forms a projecting portion 126 in the rear wall of the module B. The edge 114 of insert 106 sealingly contacts the edge 116 of casting form 12. Edge 115 of insert 106 is sealingly engaged by the end door 36 when it is raised into its upright position. Means for securing inserts 104 and 106 to the casting apparatus are provided. For example, hangers 118 can be used to secure insert 104 to the flat portion 119 of the casting apparatus by bolts 123. Brackets 120, 121 are provided to secure the insert 106 to insert 104 by suitable fasteners 125.

As earlier mentioned, FIG. 11 shows an intermediate module B after removal from the apparatus of FIG. 10. The upper slab 122 has a cantilevered edge portion 124 and a rear wall projecting portion 126 which are adapted to be received and interlocked in a horizontal ledge and vertical notch respectively of another intermediate or right hand adjacently situated crypt module, for example, the ledge 96 and notch 98 of right hand module C shown in FIG. 9. Module B is also provided with a horizontal ledge 128 (partly shown) and vertical notch 130 for receiving the cantilevered edge portion and rear wall projecting portion of an adjacent crypt module, as for example, another intermediate module B, or, a left hand module A, subsequently described herein.

In FIG. 12 the casting apparatus 10 is shown with the rear end door 36 removed to illustrate the utilization of removable inserts for casting a left hand module A (FIG. 13). Insert 90 is shown pivoted away from wall cavity 54 and insert 92 has been removed from the rear end door 36. In the position otherwise occupied by insert 90 there is located a removable insert 132 which extends along the widened portion of the outermost wall 24 (FIG. 2) of wall cavity 54 in such manner as to form a tapered planar surface 134 on the side wall of a crypt module A as illustrated in FIG. 13. Insert 132 is secured to the casting form 12 by any suitable fastening means (not shown), such as screws or the like, which may als be used to secure the insert 90 in its overhanging position with respect to wall cavity 54. Inserts 104 and 106 are shown in position in wall cavity 50 for forming a cantilevered edge portion 136 and rear wall projecting portion 138 of crypt module A of FIG. 13.

Figure 15:
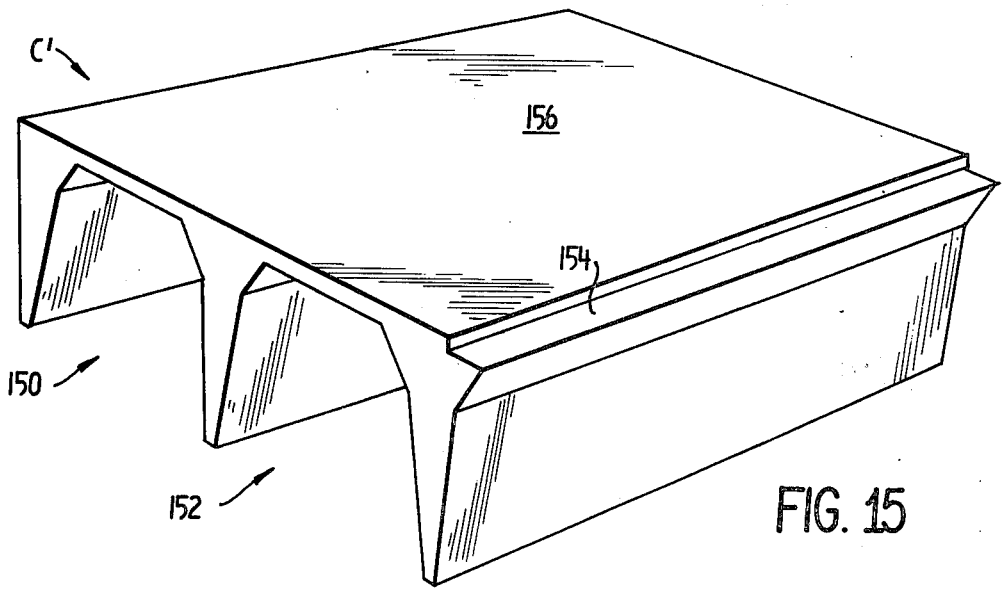
FIG. 15 shows a perspective view of the rear of a crypt module D formed in the casting apparatus of FIG. 14.
Figure 14:
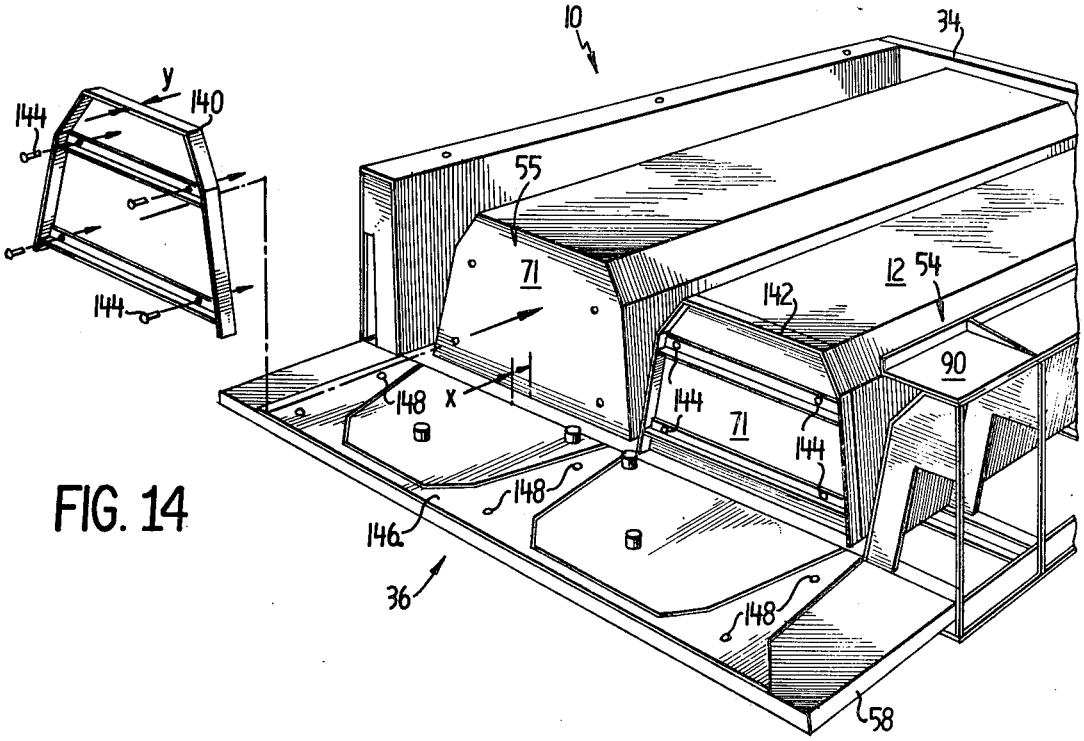
FIG. 14 is a perspective view of the casting apparatus showing the removable inserts for forming a crypt module D having front and rear crypt openings.

FIG. 14 shows the casting apparatus 10 arranged to cast module C of FIG. 15. Insert 90 is positioned to overhang and close the upper portion of wall cavity 54 to form a horizontal ledge in the module C to be cast. Inserts 140 and 142, which may be separate inserts as illustrated, or, which may be fabricated in one piece, are secured to end walls 71 of the casting form 12 using screws 144. Each of the inserts 140, 142 is shaped to conform to the edge of the casting form, as shown, and has a width y substantially equivalent to the width x of the rear wall cavity 55 bounded by the rear door 36 and the edge of the casting form wall 71. When the rear door 36 is raised to its upright position, inserts 140, 142 extend across the width x of rear wall cavity 55 and sealingly engage a mating plate 146 secured to the rear door 36 by means of screws 148. Thus, the casting apparatus 10 of FIG. 14 can yield a crypt module C′ as shown in FIG. 15 having openings 150, 152 in the rear which are similar to the front openings in the front end 38 of module 14 (FIG. 7), the purpose of which will be explained hereinafter. Module C′ (FIG. 15) includes a horizontal ledge 154, formed by insert 90, which extends the longitudinal side of upper slab 156 for receiving a cantilevered edge portion of an adjacently situated module. It should be noted that crypt module C′ is similar to module C of FIG. 9, except for the elimination of the rear wall 102 with its attendant vertical notch 98. It will be apparent that modules A, B and D could be readily produced without rear walls, in the manner described for Module C by employing the proper combination of inserts. Such modules with front and rear openings are suitable for constructing multi-tiered mausoleum structures wherein the crypts are longitudinally arranged directly behind each other to a depth of two or more units. In such a construction access to the rear crypt is had through the front openings of the forwardly disposed crypt. The abutting crypt surfaces are sealed in substantially fluid-tight relationship by a conventional sealant, such as, non-shrinking grout, butyl rubber, or the like.

Any combination of modules A, B and C will yield a mausoleum structure having an even number of crypts per tier. As illustrated and described in our U.S. Pat. No. 3,878,656, utilization of module D permits construction of a mausoleum structure having an odd number of crypts in each tier and, therefore, enhances the design flexibility of the overall modular mausoleum crypt system. FIG. 16 shows the casting apparatus 10 arranged for casting the module D of FIG. 17. An insert 148, similar in construction to insert 90, previously described, is positioned in overhanging relation above central wall cavity 52 and is secured in place to the casting form 12 by threaded inserts 152 and bolts 154 or any other suitable fastening means. Insert 148 provides a horizontal ledge 157 in the cast module D. Insert 92 is secured to the central portion of rear end door 36 with bolts 93 in the same manner as previously described in connection with FIG. 8 to provide a vertical notch 158 in the rear wall of crypt module D. Alternatively, module D can be formed in the casting apparatus 10 by using an insert similar to insert 132 (FIG. 12) arranged in the central wall cavity 52 of the casting apparatus arrangement shown in FIG. 8. Thus, module D will be formed in wall cavities 52 and 54 rather than in wall cavities 50 and 52 as shown in FIG. 16.

FIG. 17 shows a module D after removal from the apparatus of FIG. 16. The horizontal ledge 157 and vertical notch 158 are adapted to receive in interlocking relation the cantilevered edge portion and vertical notch respectively of an intermediate module B or a left hand module A to provide a tier having an odd number of crypts.

The universal casting apparatus of the present invention is particularly well suited for casting complex concrete shapes, as earlier mentioned. In part this feature is manifested by the utilization of a casting form 12 constructed and arranged to provide the proper combination of flexibility and rigidity.

As best seen in FIG. 2, the cross-sectional configuration of the thin sheet metal casting form 12 is depicted. The form 12 is a continuous member shaped to define three spaced longitudinally extending wall cavities 50, 52, 54 having closed bottoms 58'. The side walls 59' which form the lower portions of the cavities extend from the bottoms 58' thereof divergently upwardly to plane E-E' to form the side walls of a crypt module. The side walls 160 forming the upper portions of the walls of the cavities, diverge upwardly from plane E–E' at an angle greater than the angle formed by side walls 59' to form a thickened portion of the side walls of a crypt module. Wall cavity 50 has an outermost wall 26 which extends divergently upwardly at the first angle to form a planar outer surface on the crypt module side wall cast therein. The rear wall cavity 55 of the casting apparatus between the end plates 71 and rear end door 36 communicates with the rearwardly disposed open end of each cavity 50, 52, 54 so that the rear wall of a module is integrally formed with its side walls.

Many modifications and variations of the present invention, other than those described herein, are possible in light of the above teachings and within the purview of the appended claims without departing from the spirit and intended scope of the invention.

We claim:

1. A method of casting differently configured concrete crypt modules which interlock with one another when assembled in a modular mausoleum crypt structure, comprising the steps of:

providing a universal casting apparatus having a configured casting cavity for receiving a fluent casting material, said casting cavity including at least three spaced, substantially vertical elongate sidewall cavities having ends, closures arranged at the ends of the sidewall cavities, said casting cavity having an upper perimetrical edge defining an upper casting plane;

altering the configuration of the casting cavity to a first predetermined shape by rigidly securing selected ones of a plurality of removable inserts to said casting apparatus at predetermined locations thereon for forming a first crypt module having first interlocking elements and at least two sidewalls;

introducing the fluent casting material into the altered casting cavity substantially up to the upper casting plane thereof;

after introducing the fluent casting material into the cavity, locating at least two removable strip inserts onto the fluent casting material and across said casting cavity below said upper casting plane and in parallel, lengthwise alignment with predetermined ones of said sidewall cavities to form longitudinal grooves in the top surface of the crypt module being cast;

providing lifting holes in the top surface of the casting material of the first crypt module;

removing the first crypt module from the casting cavity after said casting material has at least partially set by removing the closures from the ends of the sidewall cavities, inserting pins into said lifting holes and hoisting said first crypt module from the casting cavity;

altering the configuration of the casting cavity to a second predetermined shape by rigidly securing selected one of a plurality of removable inserts to said casting apparatus at predetermined locations thereon to form a second crypt module having at least two sidewalls and second interlocking elements which interlock with the first interlocking elements of the first crypt module;

introducing the fluent casting material into the altered casting cavity substantially up to the upper casting plane thereof;

after introducing the fluent casting material into the cavity, locating at least two removable strip inserts onto the fluent casting material and across said casting cavity below said upper casting plane and in parallel, lengthwise alignment with predetermined ones of said sidewall cavities to form longitudinal grooves in the top surface of the crypt module being cast;

providing lifting holes in the top surface of the casting material of the first crypt module;

removing the second crypt module from the casting cavity after said casting material has at least partially set by removing the closures from the ends of the sidewall cavities, inserting pins into said lifting holes and hoisting said second crypt module from the casting cavity.

2. The method according to claim 1, including the step of assembling said first and second modules together at the interlocking elements thereof.

3. The method according to claim 1, including the steps of casting a plurality of differently configured crypt modules, each having at least two sidewalls, at least two longitudinal grooves and at least one of said first and second interlocking elements, assembling a first group of said differently configured modules together at the interlocking elements thereof in a first tier of crypt modules and assembling a second group of said differently configured modules together at the interlocking surfaces thereof and in superposed relation to said first tier of crypt modules in a second tier of said crypt modules with the sidewalls of said crypt modules of the second tier engaging in the longitudinal grooves of the modules in said first tier of crypt modules.

* * * * *